US010746041B2

(12) United States Patent
Patel et al.

(10) Patent No.: US 10,746,041 B2
(45) Date of Patent: Aug. 18, 2020

(54) SHROUD AND SHROUD ASSEMBLY PROCESS FOR VARIABLE VANE ASSEMBLIES

(71) Applicant: UNITED TECHNOLOGIES CORPORATION, Farmington, CT (US)

(72) Inventors: Tushar M. Patel, Rocky Hill, CT (US); Valeriy Krutiy, Westfield, MA (US); Ahamed Foliq Ahamed Laikali, Tirunelveli (IN); Saikumar Jupally, Secunderbad (IN); Gurjeet Singh, Dehradun (IN); Sidda Basha Dudekula, Hyderabad (IN)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 14 days.

(21) Appl. No.: 16/244,596

(22) Filed: Jan. 10, 2019

(65) Prior Publication Data

US 2020/0224545 A1 Jul. 16, 2020

(51) Int. Cl.

| | |
|---|---|
| ***F01D 11/08*** | (2006.01) |
| ***F01D 9/04*** | (2006.01) |
| ***F01D 25/24*** | (2006.01) |

(52) U.S. Cl.

CPC ..... *F01D 11/08* (2013.01); *F01D 9/04* (2013.01); *F01D 25/246* (2013.01); *F05D 2220/32* (2013.01); *F05D 2240/11* (2013.01); *F05D 2240/12* (2013.01)

(58) Field of Classification Search

None

See application file for complete search history.

(56) References Cited

U.S. PATENT DOCUMENTS

| | | | | |
|---|---|---|---|---|
| 4,969,326 | A | 11/1990 | Blessing et al. | |
| 6,435,820 | B1 * | 8/2002 | Overberg | F01D 25/246 415/1 |
| 8,814,507 | B1 * | 8/2014 | Campbell | F01D 5/08 415/173.1 |
| 9,097,124 | B2 | 8/2015 | Dube et al. | |
| 9,945,257 | B2 | 4/2018 | Fitzpatrick et al. | |
| 10,450,878 | B2 * | 10/2019 | Baumann | F01D 9/041 |
| 2002/0098079 | A1 * | 7/2002 | Fujikawa | F01D 9/00 415/116 |

(Continued)

FOREIGN PATENT DOCUMENTS

| | | |
|---|---|---|
| EP | 0696675 | 2/1996 |
| EP | 3009604 | 4/2016 |

(Continued)

OTHER PUBLICATIONS

European Patent Office, European Search Report dated May 7, 2020 in Application No. 20151013.8.

*Primary Examiner* — Michael Lebentritt

(74) *Attorney, Agent, or Firm* — Snell & Wilmer, L.L.P.

(57) ABSTRACT

A shroud assembly may comprise a first ring, a second ring aft of the first ring, and a shroud disposed between the first ring and the second ring. The shroud may comprise a plurality of circumferentially adjacent shroud segments. Each shroud segment of the plurality of circumferentially adjacent shroud segments may extend axially from the first ring to the second ring.

18 Claims, 9 Drawing Sheets

(56) References Cited

U.S. PATENT DOCUMENTS

2004/0005217 A1* 1/2004 Rainous ..... F01D 9/042 415/189
2006/0159549 A1* 7/2006 Durocher ..... F01D 11/005 415/170.1
2007/0020086 A1* 1/2007 Durocher ..... F01D 9/04 415/115
2008/0025838 A1 1/2008 Marini
2008/0193280 A1* 8/2008 Addis ..... B23P 6/005 415/148
2008/0206042 A1* 8/2008 Lee ..... F01D 5/143 415/116
2009/0032650 A1* 2/2009 Maehara ..... G21C 13/032 248/65
2010/0237571 A1* 9/2010 Durocher ..... F16J 15/0887 277/631
2011/0120133 A1* 5/2011 Rudrapatna ..... F23R 3/002 60/752
2015/0226124 A1* 8/2015 Tsutsumi ..... F01D 25/246 415/193
2015/0354380 A1 12/2015 Roberts et al.
2016/0169025 A1* 6/2016 Lamusga ..... F01D 11/08 415/173.1
2018/0238193 A1* 8/2018 Baucco ..... F01D 25/246
2018/0252152 A1* 9/2018 Hill ..... F01D 17/143
2018/0340440 A1* 11/2018 Freeman ..... F01D 11/08
2019/0301295 A1* 10/2019 Hernandez ..... F04D 29/321

FOREIGN PATENT DOCUMENTS

EP 3287608 2/2018
WO 2014143445 9/2014

* cited by examiner

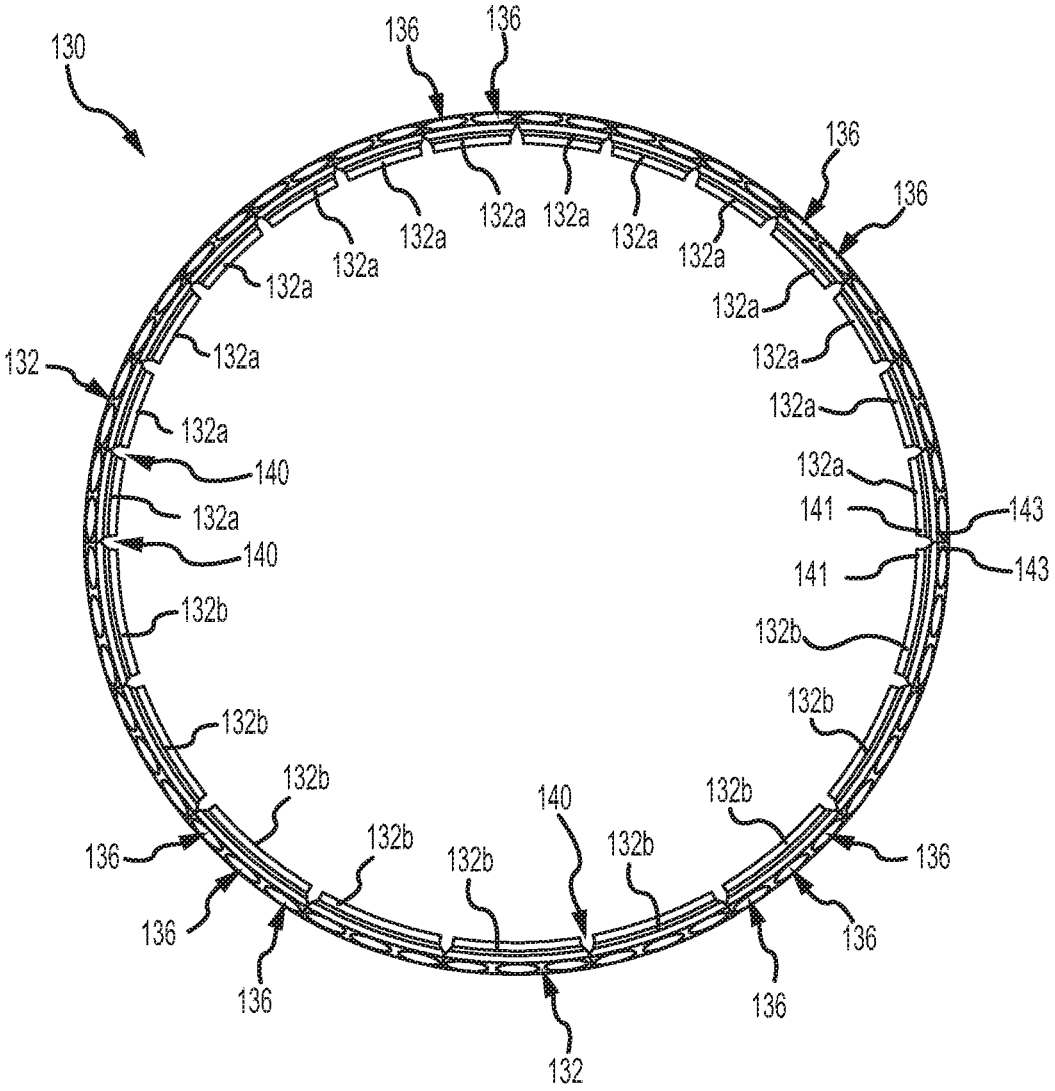
130
136
136
136
136
132a
132a
132a
132a
132a
132a
132a
132a
132a
132a
132a
132a
132a
132a
132a
132
140
132a
140
132b
132b
132b

SHROUD AND SHROUD ASSEMBLY PROCESS FOR VARIABLE VANE ASSEMBLIES

FIELD

The present disclosure relates to gas turbine engines, and more specifically, to a shroud for variable vane assemblies.

BACKGROUND

A gas turbine engine generally includes a fan section, a compressor section, a combustor section, and a turbine section. The fan section drives air along a bypass flowpath and a core flowpath. In general, during operation, air is pressurized in the compressor section and then mixed with fuel and ignited in the combustor section to generate combustion gases. The combustion gases flow through the turbine section, which extracts energy from the combustion gases to power the compressor section and generate thrust. The fan section, compressor section, and/or the turbine section may each include rotatable blade assemblies and non-rotating vane assemblies. A shroud may be located at an inner diameter of one or more of the vane assemblies.

SUMMARY

A shroud assembly is disclosed herein. In accordance with various embodiments, the shroud assembly may comprise a first ring, a second ring aft of the first ring, and a shroud disposed between the first ring and the second ring. The shroud may comprise a plurality of circumferentially adjacent shroud segments. Each shroud segment of the plurality of circumferentially adjacent shroud segments may extend axially from the first ring to the second ring.

In various embodiments, at least one of the first ring or the second ring may include an anti-rotation protrusion located between a first shroud segment and a second shroud segment of the plurality of circumferentially adjacent shroud segments. The first shroud segment may be circumferentially adjacent to the second shroud segment.

In various embodiments, the first shroud segment may define a first number of vane apertures and the second shroud segment may define a second number of vane apertures different from the first number of vane apertures. In various embodiments, each vane aperture of the first number of vane apertures may comprise a first bore including a first diameter and a second bore including a second diameter less than the first diameter.

In various embodiments, the plurality of circumferentially adjacent shroud segments may comprises a plurality of first shroud segments and a plurality of second shroud segments. Each first shroud segment of the plurality of first shroud segments may define two vane apertures, and each second shroud segment of the plurality of second shroud segments may define three vane apertures.

In various embodiments, a first shroud segment of the plurality of first shroud segments may form a first percentage of an outer circumference of the shroud, and a second shroud segment of the plurality of second shroud segments may form a second percentage of the outer circumference of the shroud different from the first percentage A vane assembly for a gas turbine engine is also disclosed herein. In accordance with various embodiments, the vane assembly may comprise an outer case, a first vane radially inward of the outer case, and a shroud assembly located radially inward of the first vane. The shroud assembly may comprise a first ring, a second ring, and a shroud disposed between the first ring and the second ring. The shroud may comprise a plurality of circumferentially adjacent shroud segments. Each shroud segment of the plurality of circumferentially adjacent shroud segments may extend axially from the first ring to the second ring.

In various embodiments, a plurality of vanes including the first vane may be radially inward of the outer case. A first shroud segment of the plurality of circumferentially adjacent shroud segments may receive a first number of vanes of the plurality of vanes, and a second shroud segment of the plurality of circumferentially adjacent shroud segments may receive a second number of vanes of the plurality of vanes different from the first number of vanes.

In various embodiments, the first vane may comprise an inner diameter trunnion located within a vane aperture defined by a shroud segment of the plurality of circumferentially adjacent shroud segments, and an outer diameter trunnion located within an outer vane aperture defined by the outer case. In various embodiments, a bushing may be located between the outer case and the outer diameter trunnion of the first vane. A distance between an outer circumferential surface of the outer diameter trunnion and an inner circumferential surface of the bushing may be configured to allow the outer diameter trunnion to tilt circumferentially within the bushing.

In various embodiments, at least one of the first ring or the second ring may include an anti-rotation protrusion. A first circumferential end of a first shroud segment of the plurality of circumferentially adjacent shroud segments and a second circumferential end of a second shroud segment of the plurality of circumferentially adjacent shroud segments may define a gap configured to receive the anti-rotation protrusion.

In various embodiments, each shroud segment of the plurality of circumferentially adjacent shroud segments may comprises a forward lip located radially inward of an aftward extending flange of the first ring, and an aft lip located radially inward of a forward extending flange of the second ring. In various embodiments, a circumferential surface of each shroud segment of the plurality of circumferentially adjacent shroud segments may define a groove.

A shroud for a variable vane assembly is also disclosed herein. In accordance with various embodiments, the shroud may comprise a first shroud segment defining a first number of vane apertures, and a second shroud segment defining a second number of vane apertures different from the first number of vane apertures.

In various embodiments, a radially outward portion of the first shroud segment may contact a radially outward portion of the second shroud segment. A radially inward portion of the first shroud segment may be spaced apart circumferentially from a radially inward portion of the second shroud segment.

In various embodiments, the first shroud segment and the second shroud segment may each comprise a first axial surface, a second axial surface oriented away from the first axial surface, a forward lip extending in a first direction from the first axial surface, and an aft lip extending in a second direction from the second axial surface. The second direction may be opposite the first direction.

In various embodiments, a circumferential surface of at least one of the first shroud segment of the second shroud segment may define a groove. In various embodiments, the first shroud segment may define two vane apertures.

In various embodiments, a third shroud segment may be circumferentially adjacent to the second shroud segment. A radially outward portion of the second shroud segment may contact a radially outward portion of the third shroud segment. A radially inward portion of the second shroud segment may be spaced apart circumferentially from a radially inward portion of the third shroud segment.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

FIG. 3 illustrates a perspective view of a shroud having circumferentially adjacent shroud segments, in accordance with various embodiments;

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims. Furthermore, any reference to singular includes plural embodiments, and any reference to more than one component or step may include a singular embodiment or step. Also, any reference to attached, fixed, coupled, connected or the like may include permanent, removable, temporary, partial, full and/or any other possible attachment option. Additionally, any reference to without contact (or similar phrases) may also include reduced contact or minimal contact.

Cross hatching lines may be used throughout the figures to denote different parts but not necessarily to denote the same or different materials. Throughout the present disclosure, like reference numbers denote like elements. Accordingly, elements with like element numbering may be shown in the figures, but may not necessarily be repeated herein for the sake of clarity.

As used herein, "aft" refers to the direction associated with a tail (e.g., the back end) of an aircraft, or generally, to the direction of exhaust of a gas turbine engine. As used herein, "forward" refers to the direction associated with a nose (e.g., the front end) of the aircraft, or generally, to the direction of flight or motion.

A first component that is "radially outward" of a second component means that the first component is positioned at a greater distance away from a common axis (e.g., the engine central longitudinal axis) than the second component. A first component that is "radially inward" of a second component means that the first component is positioned closer to the common axis than the second component. In the case of components that rotate circumferentially about a common axis, a first component that is radially inward of a second component rotates through a circumferentially shorter path than the second component.

Figure 1:
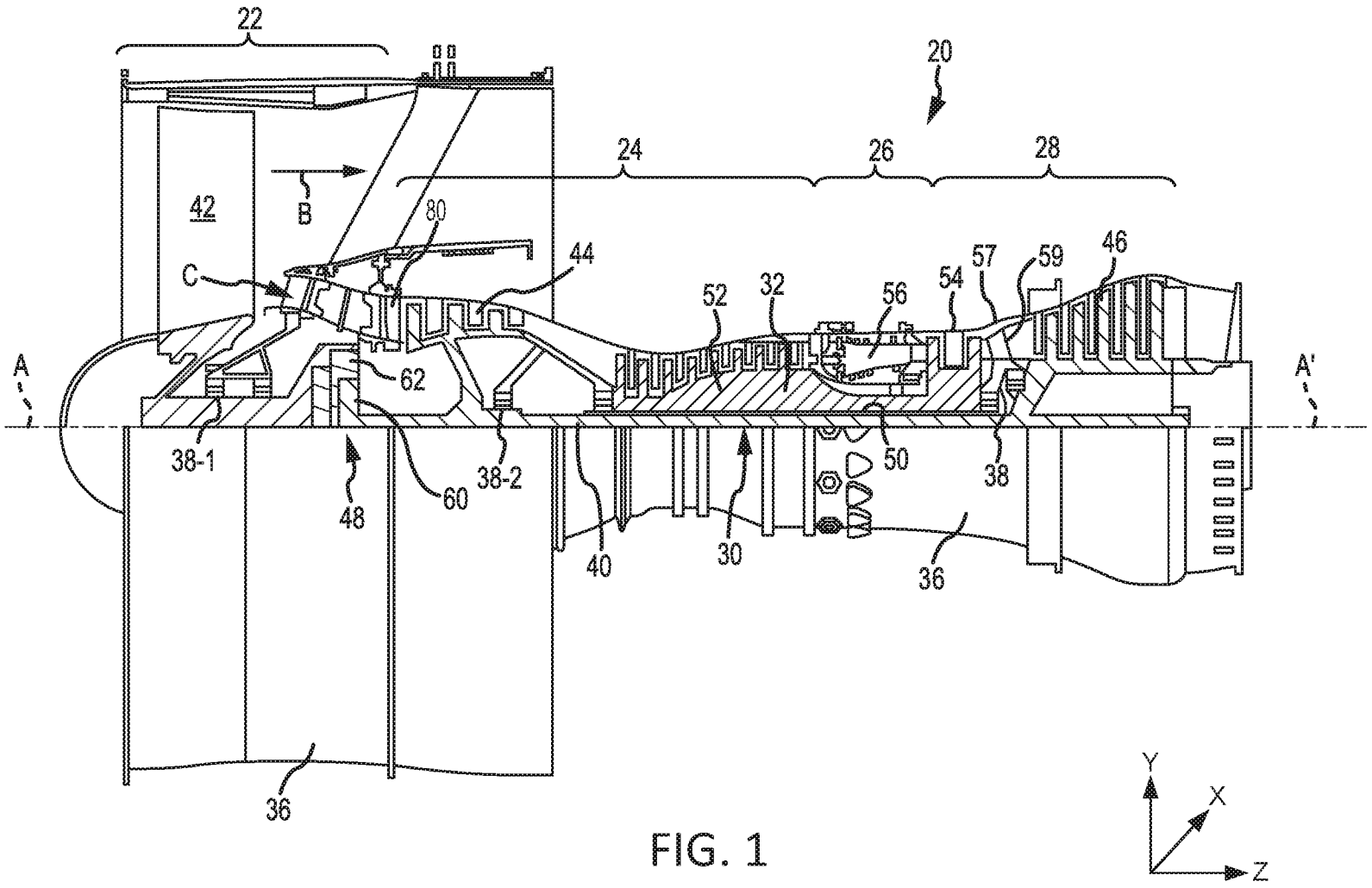
FIG. 1 illustrates a cross-sectional view of an exemplary gas turbine engine, in accordance with various embodiments.

With reference to FIG. 1, an exemplary gas turbine engine 20 is provided, in accordance with various embodiments. Gas turbine engine 20 may be a two-spool turbofan that generally incorporates a fan section 22, a compressor section 24, a combustor section 26, and a turbine section 28. In operation, fluid (e.g., air) output from fan section 22 is driven along a bypass flow-path B, located generally between gas turbine engine 20 and a nacelle structure, and a core flow-path C, comprised generally of the flowpath through compressor section 24, a combustor section 26, and a turbine section 28. Compressor section 24 drives air along core flow-path C for compression and communication into combustor section 26 and then expansion through turbine section 28. Although depicted as a turbofan gas turbine engine 20 herein, it should be understood that the concepts described herein are not limited to use with two-spool turbofans as the teachings may be applied to other types of turbine engines including single-spool architectures, multi-spool architectures, as well as industrial gas turbines.

Gas turbine engine 20 may generally comprise a low speed spool 30 and a high speed spool 32 mounted for rotation about an engine central longitudinal axis A-A' relative to an engine static structure 36 via one or more bearing systems 38 (shown as bearing system 38, 38-1, and 38-2). It should be understood that various bearing systems 38 at various locations may alternatively or additionally be provided including, for example, bearing system 38, bearing system 38-1, and bearing system 38-2. Engine central longitudinal axis A-A' is oriented in the z direction (i.e., axial direction) on the provided xyz axes. The y direction on the provided xyz axes refers to the radial direction and the x direction on the provided xyz axes refers to the circumferential direction.

Low speed spool 30 may generally comprise an inner shaft 40 that interconnects a fan 42, a low pressure compressor 44, and a low pressure turbine 46. Inner shaft 40 may be connected to fan 42 through a geared architecture 48 that can drive fan 42 at a lower speed than low speed spool 30. Geared architecture 48 may comprise a gear assembly 60 enclosed within a gear housing 62. Gear assembly 60 couples inner shaft 40 to a rotating fan structure. High speed spool 32 may comprise an outer shaft 50 that interconnects a high-pressure compressor 52 and a high pressure turbine 54. A combustor 56 may be located between high pressure compressor 52 and high pressure turbine 54. Inner shaft 40 and outer shaft 50 may be concentric and rotate via bearing systems 38 about the engine central longitudinal axis A-A', which is collinear with their longitudinal axes. As used herein, a "high pressure" compressor or turbine experiences a higher pressure than a corresponding "low pressure" compressor or turbine.

The airflow along core flow-path C may be compressed by low pressure compressor 44 then by high pressure compressor 52, mixed and burned with fuel in combustor 56, then expanded over high pressure turbine 54 and low pressure turbine 46. Low pressure turbine 46 and high pressure turbine 54 rotationally drive, respective, low speed spool 30 and high speed spool 32 in response to the expansion. Fan section 22, compressor section 24, and/or turbine section 28 may each include blade assemblies configured to rotate about engine central longitudinal axis A-A' and stationary vane assemblies, which do not rotation about engine central longitudinal axis A-A'.

Figure 2A:
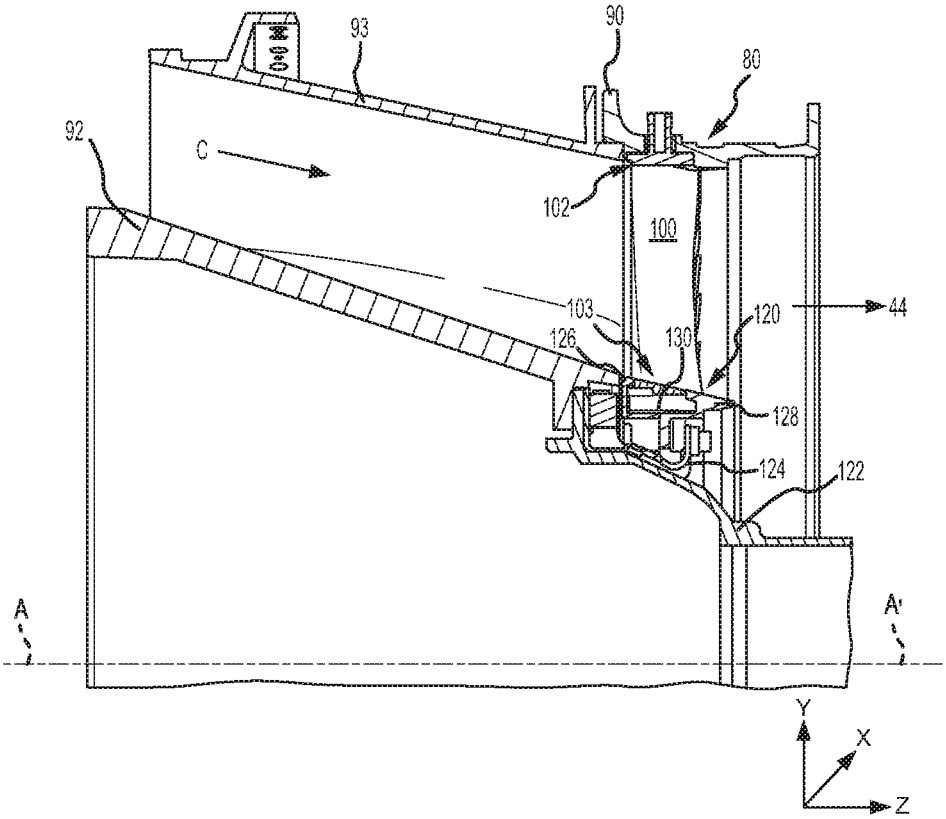
FIG. 2A illustrates a cross-sectional view of a vane assembly of a low pressure compressor of a gas turbine engine, in accordance with various embodiments.

Referring to FIG. 2A, and with continued reference to FIG. 1, a vane assembly 80 of low pressure compressor 44 is illustrated, in accordance with various embodiments. Vane assembly 80 includes a plurality of vanes, or airfoils, 100. Vanes 100 are arranged circumferentially about engine central longitudinal axis A-A'. Vanes 100 may be configured to direct the airflow output from fan 42 into low pressure compressor 44. In various embodiments, vane assembly 80 may be a variable vane assembly, meaning the angle of attack of vanes 100 may be variable relative to the airflow direction proximate an inlet, or leading edge, of vanes 100. Stated differently, the angle of attack of vanes 100 may be variable (i.e., changed) during operation. For example, the angle of attack of vanes 100 may be change depending on the flight cycle (e.g., the angle of attack of vanes 100 during take-off may be different from the angle of attack of vanes 100 during cruise).

In various embodiments, vane assembly 80 may be located proximate an aft end of a front center body 92 of gas turbine engine 20. In various embodiments, front center body 92 may define a forward, or inlet, portion of core flow-path C. Front center body 92 may be located forward of, and/or may be coupled to, a low pressure compressor case 90. An outer diameter (OD) vane end 102 of each vane 100 is coupled to low pressure compressor case 90. In various embodiments, low pressure compressor case 90 and a radially outward portion 93 of front center body 92 may form portions of engine static structure 36 (FIG. 1).

Figure 2B:
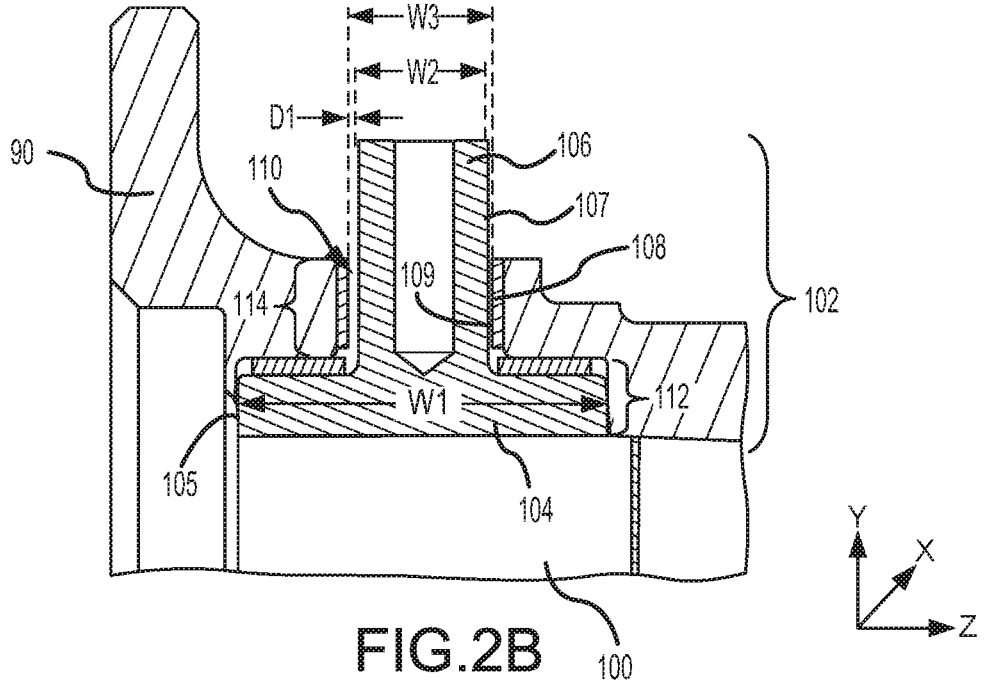
FIG. 2B illustrates a cross-sectional view of an outer diameter end of the vane assembly of FIG. 2A, in accordance with various embodiments.

With reference to FIG. 2B, OD vane end 102 of a vane 100 is illustrated, in accordance with various embodiments. OD vane end 102 may include an OD button 104 and an OD trunnion 106. OD trunnion 106 may extend radially outward from OD button 104. OD button 104 includes a width, or diameter, W1 as measured at an outer circumferential surface 105 of OD button 104. OD trunnion 106 includes a width, or diameter, W2 as measured at an outer circumferential surface 107 of OD trunnion 106. Width W1 of OD button 104 is greater than width W2 of OD trunnion 106. OD vane end 102 may be located in an outer vane aperture 110 defined by low pressure compressor case 90. Outer vane aperture 110 may include a radially inward (or first) bore 112 and a radially outward (or second) bore 114. Radially inward bore 112 is configured to receive OD button 104. Radially outward bore 114 is configured to receive OD trunnion 106.

In various embodiments, a bushing 108 may be located between low pressure compressor case 90 and OD trunnion 106. Bushing 108 includes a width, or diameter, W3 as measured at an inner circumferential surface 109 of bushing 108. Width W3 of bushing 108 is greater than width W2 of OD trunnion 106. As discussed in further detail below, a distance D1 between outer circumferential surface 107 of OD trunnion 106 and inner circumferential surface 109 of bushing 108 is selected to create a clearance between OD trunnion 106 and inner circumferential surface 109. The clearance is configured to allow OD trunnion 106 to tilt circumferentially, as shown in FIG. 9B, within bushing 108, during installation of the shroud segments. In various embodiments, distance D1 may be at least 0.0004 inches (0.0102 millimeters (mm)). In various embodiments, distance D1 may be at least 0.0008 inches (0.0203 mm). In various embodiments, distance D1 may be at least 0.0012 inches (0.0305 mm). In various embodiments, distance D1 may be at least 0.0025 inches (0.0635 mm).

Returning to FIG. 2A, vane assembly 80 further includes a shroud assembly 120. Shroud assembly 120 is located at an inner diameter (ID) vane end 103 of vanes 100. Shroud assembly 120 may be coupled to front center body 92 and/or to a bearing support 122 (e.g., the #2 bearing support) of gas turbine engine 20 via a ring support 124. While shroud assembly 120 is illustrated and described with reference to a variable vane assembly at the forward end of low pressure compressor 44, it is further contemplated and understood that shroud assemblies as described herein may be employed in downstream variable vane assemblies of low pressure compressor 44 and/or in variable vane assemblies in high pressure compressor 52 and in fan section 22.

Figure 2C:
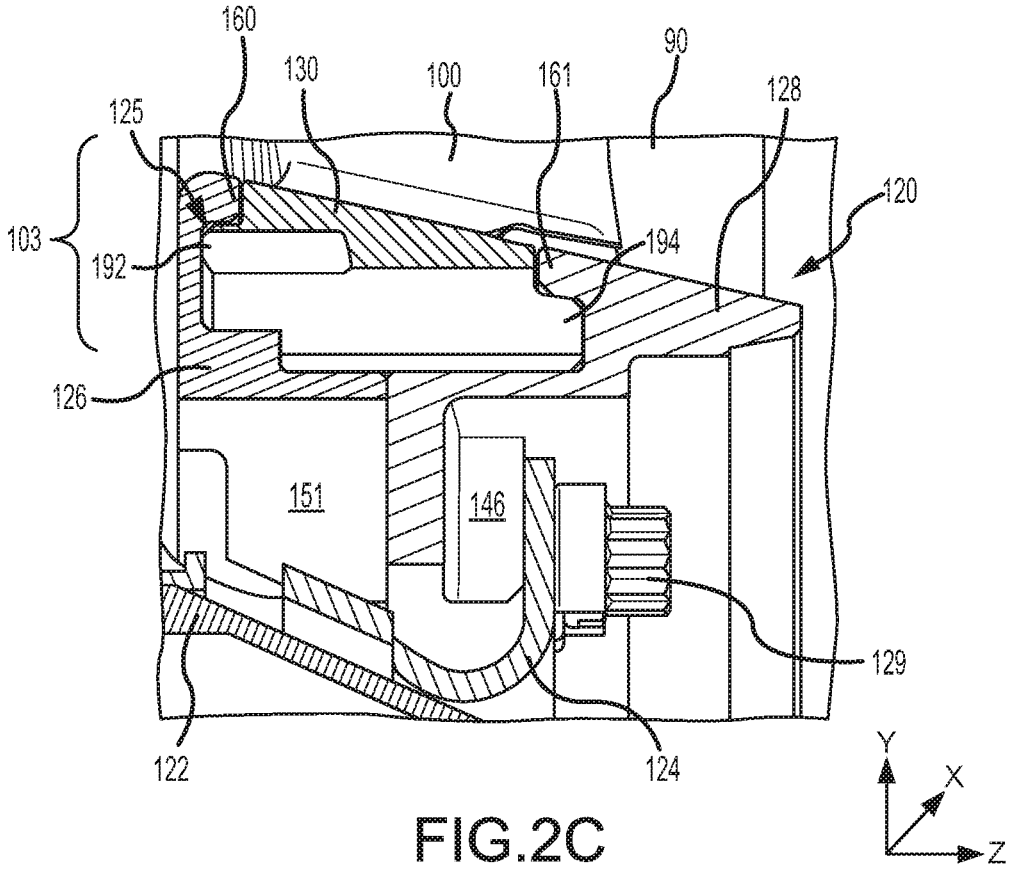
FIG. 2C illustrates a cross-sectional view of a shroud assembly located at an inner diameter end of the vane assembly of FIG. 2A, in accordance with various embodiments.

FIG. 2C illustrates shroud assembly 120 at the ID vane end 103 of a vane 100. Shroud assembly 120 includes a forward (or first) ring 126 and an aft (or second) ring 128. Forward ring 126 is located forward of aft ring 128. Forward ring 126 and aft ring 128 may each comprise annular, ring-shaped structures that extend continuously, or 360°, about engine central longitudinal axis A-A'. In various embodiments, forward ring 126 and/or aft ring 128 may comprise a split ring. Forward ring 126 and aft ring 128 may be coupled to ring support 124 via a fastener 129. Fastener 129 may comprise a screw, rivet, nut and bolt, clip, or any other suitable securement device. Fastener 129 may be located through an aft opening 144, with momentary reference to FIG. 4, defined by a radially inward extending flange 146 of aft ring 128, and through a forward opening 148, with momentary reference to FIG. 5, defined by a radially inward extending flange 151 of forward ring 126.

Returning to FIG. 2C, shroud assembly 120 further includes a shroud 130 located between forward ring 126 and aft ring 128. In this regard, forward ring 126 and aft ring 128 define a channel 125 configured to receive shroud 130.

With reference to FIG. 3, shroud 130 is illustrated, in accordance with various embodiments. Shroud 130 includes a plurality of circumferentially adjacent shroud segments 132. Shroud segments 132 form a generally annular, or ring, shaped structure. In various embodiments, shroud 130 includes a plurality of first shroud segments 132*a* and a plurality of second shroud segments 132*b*. In various embodiments, first shroud segments 132*a* form approximately 180°, or one-half, of shroud 130, and second shroud segments 132*b* form approximately 180°, or one-half, of shroud 130. As used in the previous context only, "approximately" means±2°. First and second shroud segments 132*a*, 132*b* each include (i.e., define) one or more vane apertures 136.

Figure 9A:
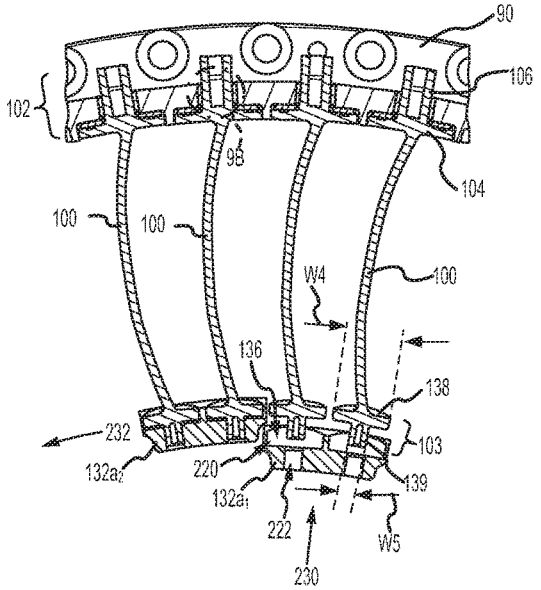
FIG. 9A illustrates a shroud segment being inserted radially at an inner diameter end of a vane, in accordance with various embodiments.
Figure 9B:
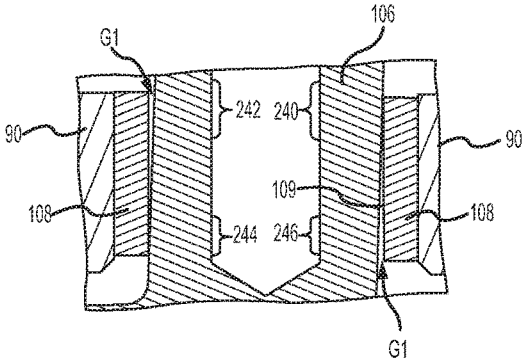
FIG. 9B illustrates an outer diameter end of a vane in the area labeled 9B in FIG. 9A, in accordance with various embodiments.

With reference to FIG. 9A, vane apertures 136 are configured to receive ID vane ends 103. In various embodiments, ID vane ends 103 may each include an ID button 138 and an ID trunnion 139. ID trunnion 139 may extend radially inward from ID button 138. ID button 138 includes a width, or diameter, W4 as measured at an outer circumferential surface of ID button 138. ID trunnion 139 includes a width, or diameter, W5 as measured at an outer circumferential surface of ID trunnion 139. Width W4 of ID button 138 is greater than width W5 of ID trunnion 139. Vane apertures 136 may include a radially outward (or first) bore 220 and a radially inward (or second) bore 222. Radially outward bore 220 is configured to receive ID button 138. Radially inward bore 222 is configured to receive ID trunnion 139.

Returning to FIG. 3, the number of vane apertures 136 defined by each first and second shroud segment 132*a*, 132*b* and the number of first and second shroud segments 132*a*, 132*b* within shroud 130 may be determined based on the total number of vanes 100 within vane assembly 80. In various embodiments, first shroud segments 132*a* may define a different number of vane apertures 136 as compared to second shroud segments 132*b*. For example, in various embodiments, each first shroud segment 132*a* may define two vane apertures 136 and each second shroud segments 132*b* may define three vane apertures 136. In various embodiments, a circumferential length C1, with momentary reference to FIG. 6A, of each first shroud segment 132*a* is less than a circumferential length C2, with momentary reference to FIG. 7A, of each second shroud segment 132*b*. Stated differently, the percentage of the outer circumference of shroud 130 formed by each first shroud segment 132*a* may different than the percentage of the outer circumference formed by each second shroud segment 132*b*. For example, a first shroud segment 132*a* may form 3%, 5%, 10%, etc. of the outer circumference of shroud 130 and a second shroud segment 132*b* may form 5%, 10%, 15%, etc. of the outer circumference.

While shroud 130 is shown as including fourteen (14) first shroud segments 132*a*, having two vane apertures 136, and nine (9) second shroud segments 132*b*, having three vane apertures 136, with first shroud segments 132*a* and second shroud segments 132*b* each spanning a continuous 180° of shroud 130, other configurations are contemplated and within the scope of the present disclosure. In this regard, the number of vane apertures per shroud segment, the number of shroud segments per shroud, the circumferential length of the shroud segments, and/or the arrangement of the shroud segments within the shroud may be determined based on the total number vanes 100 in vane assembly 80 and/or the dimensions, flow characteristics, or other desired operating parameters of low pressure combustor 44 and/or gas turbine engine 20.

In various embodiments, shroud segments 132 are configured to define a gap 140 between each pair of circumferentially adjacent shroud segments 132. Stated differently, a radially inward portion 141 of each shroud segment 132 may be spaced apart circumferentially from the radially inward portion 141 of the circumferentially adjacent shroud segments 132, thereby forming gaps 140 between the radially inward portions 141 of each pair of circumferentially adjacent shroud segments 132. In various embodiments, a radially outward portion 143 of each shroud segment 132 contacts the radially outward portion 143 of the circumferentially adjacent shroud segments 132.

Figure 6A:
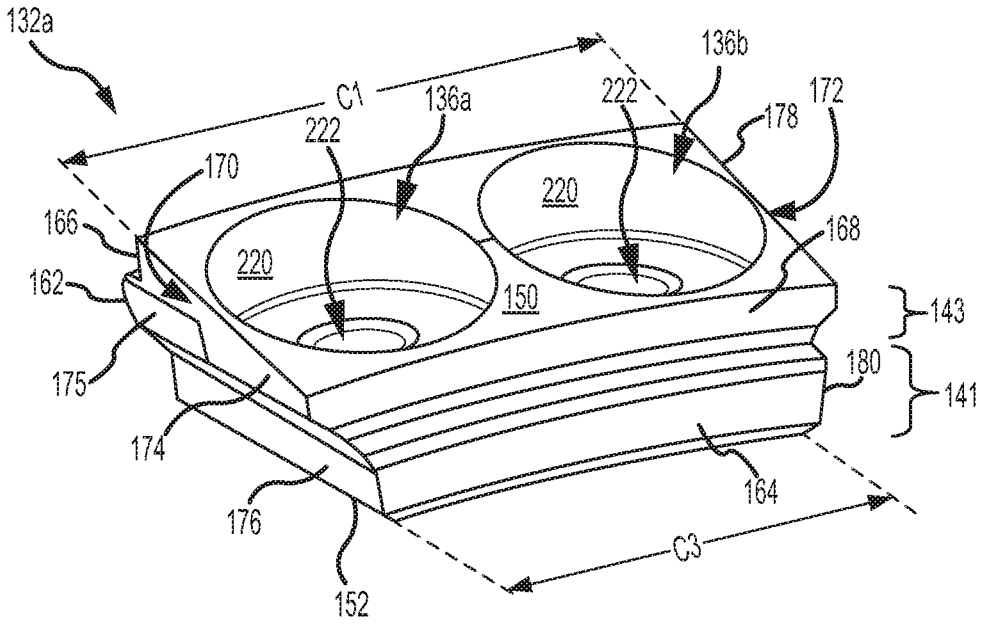
FIGS. 6A and 6B illustrate a perspective forward view and a perspective side view, respectively, of a shroud segment having two vane apertures, in accordance with various embodiments.

With momentary reference to FIG. 6A, circumferential length C1 of each first shroud segment 132*a*, as measured at an outer circumferential surface 150 of first shroud segment 132*a*, is greater than a circumferential length C3 of first shroud segment 132*a*, as measured at an inner circumferential surface 152 of first shroud segments 132*a*. With momentary reference to FIG. 7A, circumferential length C2 of each second shroud segment 132*b*, as measured at an outer circumferential surface 154 of second shroud segments 132*b*, is greater than a circumferential length C4 of second shroud segment 132*b*, as measured at an inner circumferential surface 156 of second shroud segment 132*b*. Outer circumferential surfaces 150, 154 are oriented in radially outward direction or generally away from engine central longitudinal axis A-A'. Inner circumferential surfaces 152, 156 are oriented in a radially inward direction, or generally toward from engine central longitudinal axis A-A'.

Figure 4:
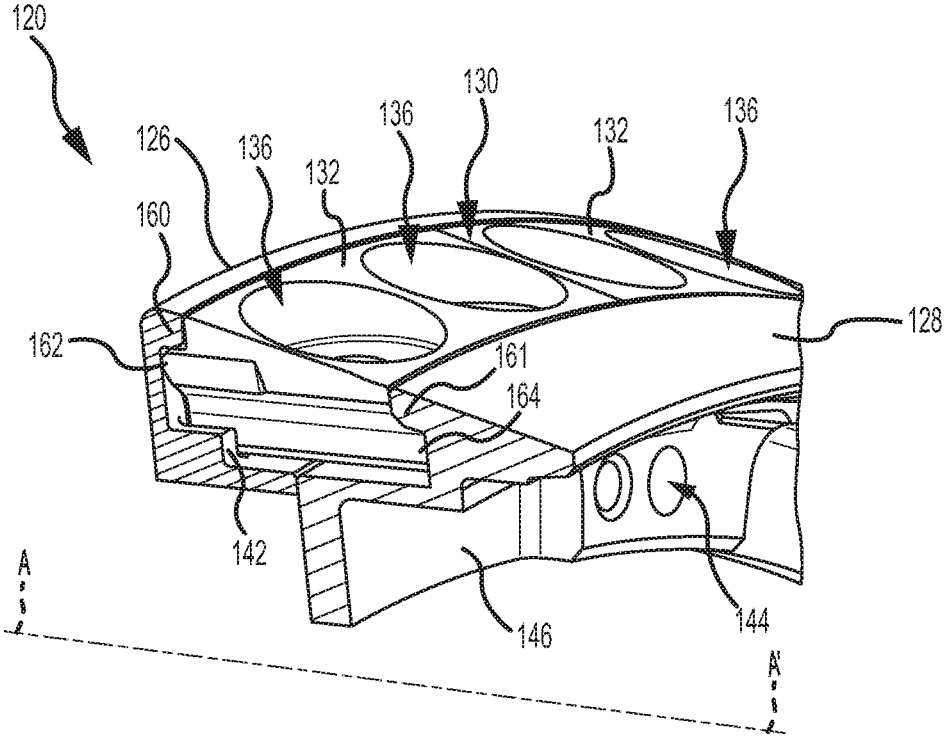
FIG. 4 illustrates a perspective cross-section of a shroud assembly, in accordance with various embodiments.

With reference to FIG. 4, a perspective cross-section of shroud assembly 120 is illustrated, in accordance with various embodiments. Shroud segments 132 extend axially from forward ring 126 to aft ring 128. Shroud segments 132 are located radially inward of an aftward extending flange 160 of forward ring 126. Shroud segments 132 are also located radially inward a forward extending flange 161 of aft ring 128. Aftward extending flange 160 and forward extending flange 161 may be configured to limit radially outward translation of shroud segments 132.

Figure 5:
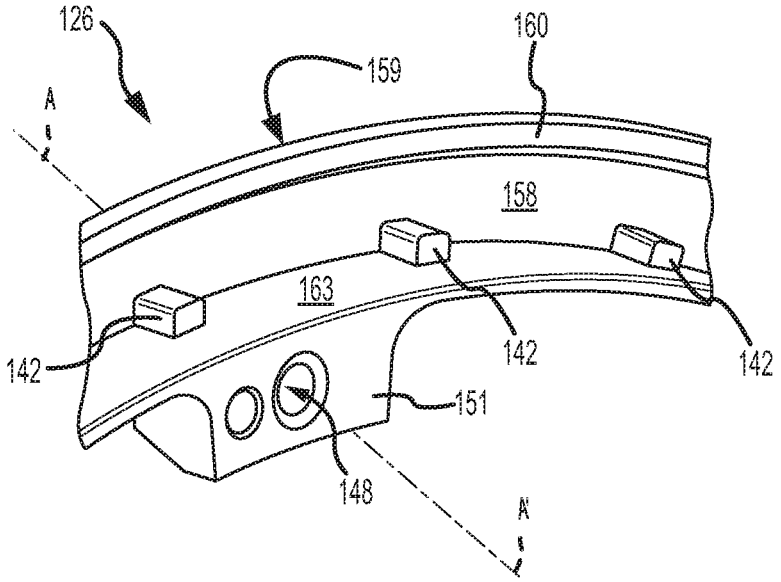
FIG. 5 illustrates a perspective view of a forward ring of a shroud assembly, in accordance with various embodiments.

Referring to FIG. 5, a perspective view of a portion of forward ring 126 is illustrated. In various embodiments, forward ring 126 may include one or more anti-rotation protrusion(s) 142. Anti-rotation protrusions 142 may extend aftward from an aft surface 158 of forward ring 126. Aft surface 158 is oriented in an aft direction and is generally opposite a forward surface 159 of forward ring 126. Anti-rotation protrusions 142 extend radially outward from a radially outward surface 163 of forward ring 126.

With combined reference to FIG. 4 and FIG. 5, anti-rotation protrusions 142 may be located between circumferentially adjacent shroud segments 132. Gaps 140, with momentary reference to FIG. 3, are configured to received anti-rotation protrusions 142. Locating one or more anti-rotation protrusions 142 between circumferentially adjacent shroud segments 132 may limit circumferential translation of shroud 130. In various embodiments, aft ring 128 may include anti-rotation protrusions, similar to anti-rotation protrusions 142.

Figure 6B:
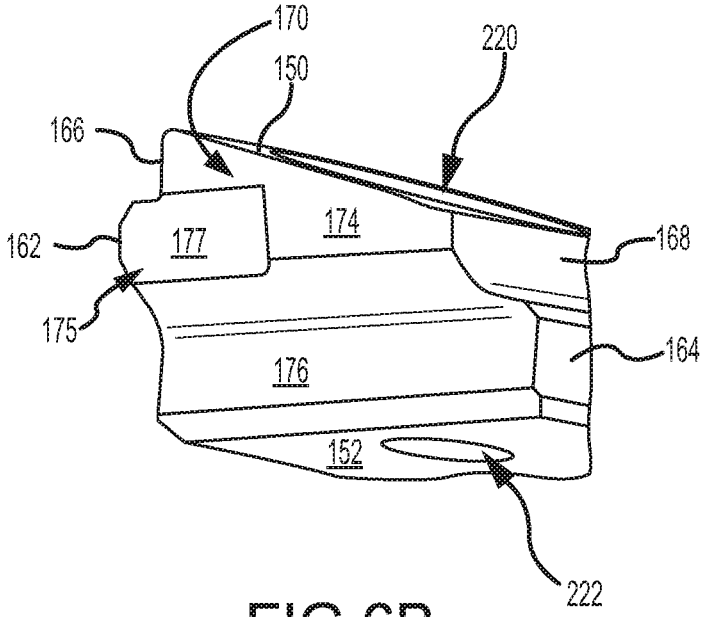

FIGS. 6A and 6B illustrate, in accordance with various embodiments, a first shroud segment 132*a* of shroud 130. First shroud segment 132*a* includes a forward lip 162 and an aft lip 164. Forward lip 162 extends in forward direction from a first axial surface 166 of first shroud segment 132*a*. Aft lip 164 extends in an aftward direction from a second axial surface 168 of first shroud segment 132*a*. First axial surface 166 is oriented in forward direction and generally away from second axial surface 168. With momentary reference to FIG. 3, forward lip 162 is located radially inward from, and may contact, aftward extending flange 160 of forward ring 126. Aft lip 164 is located radially inward from, and may contact, forward extending flange 161 of aft ring 128.

Returning to FIGS. 6A and 6B, first and second axial surfaces 166, 168 extend from a first circumferential end 170 to a second circumferential end 172 of first shroud segment 132*a*. First circumferential end 170 is opposite second circumferential end 172. First circumferential end 170 includes a radially outward circumferential surface 174 and a radially inward circumferential surface 176. Second circumferential end 172 includes a radially outward circumferential surface 178 and a radially inward circumferential surface 180. First circumferential end 170 is oriented toward the second circumferential end 172 of the circumferentially adjacent shroud segment, such that radially outward circumferential surface 174 contacts radially outward circumferential surface 178 of the circumferentially adjacent shroud segment. Radially inward circumferential surface 176 is recessed with respect to radially outward circumferential surface 174. In this regard, the circumferential length C1 from radially outward circumferential surface 174 to radially outward circumferential surface 178 is greater than the circumferential length C3 from radially inward circumferential surface 176 to radially inward circumferential surface 180.

In various embodiments, a groove 175 may be formed in radially outward circumferential surface 174. In various embodiments, a groove, similar to groove 175 may be formed in radially outward circumferential surface 178. Groove 175 may be defined by a circumferentially slanted surface 177. Stated differently, groove 175 may vary in depth, such that a depth of groove 175, as measured in a circumferential direction, decreases in a radially outward direction. As discussed in further detail below, groove 175 may be configured to reduce interference and allow for smoother insertion of circumferentially adjacent shroud segments 132 during assembly of shroud 130.

In various embodiments, first shroud segment 132*a* may be a unibody, or monolithic, structure. In this regard, first shroud segment 132*a* may be formed as a single piece. In various embodiments, first shroud segment 132*a* may be a split structure formed by two or more joined pieces. In various embodiments, first shroud segment 132*a* may define two vane apertures. For example, first shroud segment 132*a* may include a vane aperture 136*a* located proximate first circumferential end 170, and a vane aperture 136*b* located proximate second circumferential end 172. Vane aperture 136*b* is circumferentially adjacent to vane aperture 136*a*. Vane apertures 136*a*, 136*b* may each include a radially outward bore 220 and a radially inward bore 222. Radially outward bores 220 may be defined by radially outward portion 143*a* of first shroud segment 132*a*. Radially inward bores 222 may be defined by radially inward portion 141*a* of first shroud segment 132*a*.

Figure 7A:
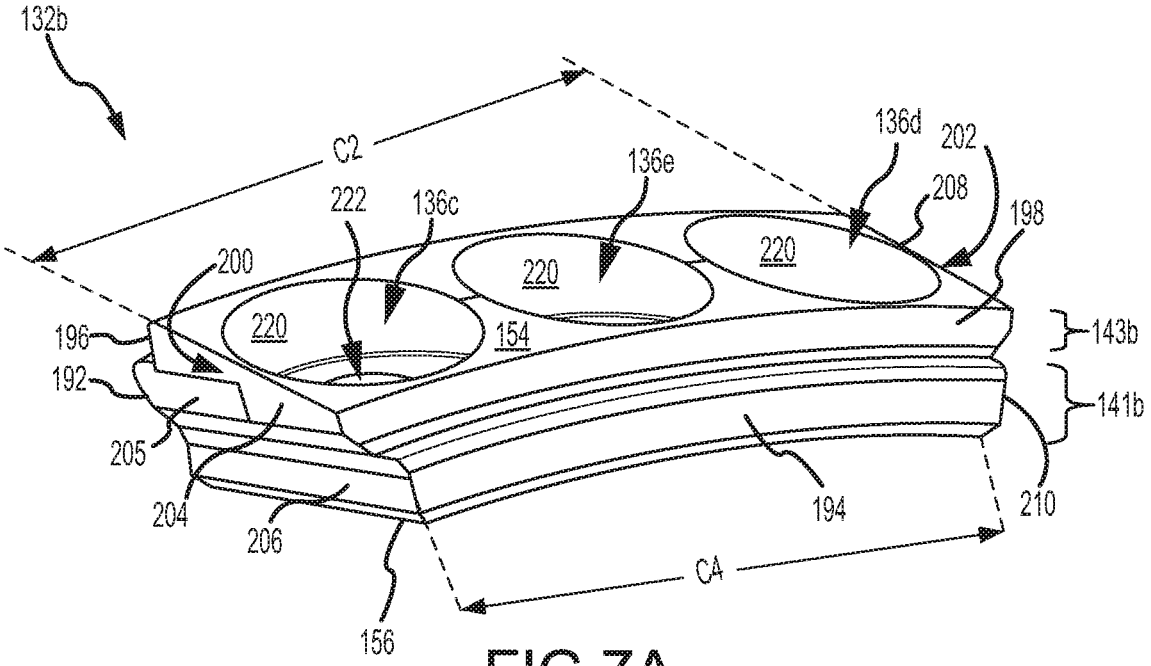
FIGS. 7A and 7B illustrate a perspective forward view and a perspective side view, respectively, of a shroud segment having three vane apertures, in accordance with various embodiments.
Figure 7B:
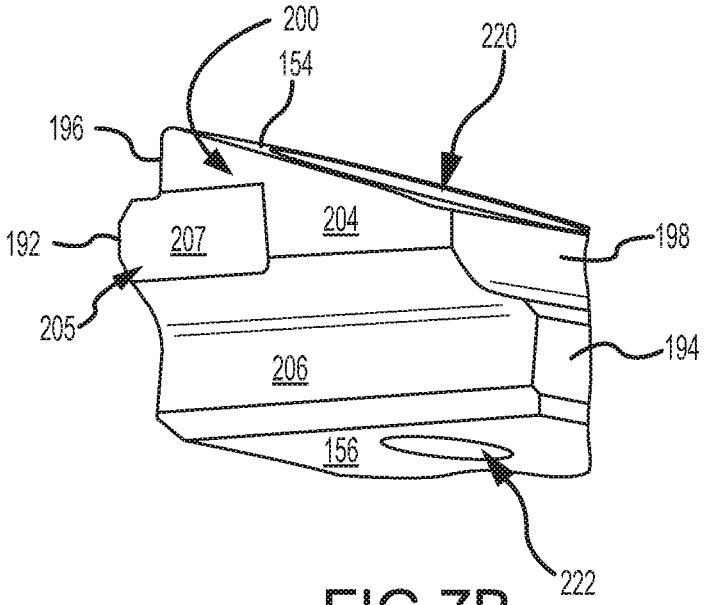

FIGS. 7A and 7B illustrate, in accordance with various embodiments, a second shroud segment 132*b* of shroud 130. Second shroud segment 132*b* includes a forward lip 192 and an aft lip 194. Forward lip 192 extends in forward direction from a first axial surface 196 of second shroud segment 132*b*. Aft lip 194 extends in an aftward direction from a second axial surface 198 of second shroud segment 132*b*. First axial surface 196 is oriented in forward direction and generally away from second axial surface 198. With momentary reference to FIG. 2C, forward lip 192 is located radially inward from, and may contact, aftward extending flange 160 of forward ring 126. Aft lip 194 is located radially inward from, and may contact, forward extending flange 161 of aft ring 128.

Returning to FIGS. 7A and 7B, first and second axial surfaces 196, 198 extend from a first circumferential end 200 to a second circumferential end 202 of second shroud segment 132*b*. Second circumferential end 202 is opposite first circumferential end 200. First circumferential end 200 includes a radially outward circumferential surface 204 and a radially inward circumferential surface 206. Second circumferential end 202 includes a radially outward circumferential surface 208 and a radially inward circumferential surface 210. First circumferential end 200 is oriented toward the second circumferential end 202 of the circumferentially adjacent second shroud segment 132*b*, such that radially outward circumferential surface 204 contacts radially outward circumferential surface 208 of the circumferentially adjacent shroud segment. Radially inward circumferential surface 206 is recessed with respect to radially outward circumferential surface 204. In this regard, the circumferential length C2 from radially outward circumferential surface 204 to radially outward circumferential surface 208 is greater than the circumferential length C4 from radially inward circumferential surface 206 to radially inward circumferential surface 210.

In various embodiments, a groove 205 may be formed in radially outward circumferential surface 204. In various embodiments, a groove, similar to groove 205 may be formed in radially outward circumferential surface 208. Groove 205 may be defined by a circumferentially slanted surface 207. Stated differently, groove 205 may vary in depth, such that a depth of groove 205, as measured in a circumferential direction, decreases in the radially outward direction. As discussed in further detail below, groove 205 may be configured to reduce interference between adjacent shroud segments 132 during assembly of shroud 130.

In various embodiments, second shroud segment 132*b* may be a unibody, or monolithic, structure. In this regard, second shroud segment 132*b* may be formed as a single piece. In various embodiments, second shroud segment 132*b* may be a split structure formed by two or more joined pieces. In various embodiments, second shroud segment 132*b* defines three vane apertures. For example, second shroud segment 132*b* may include a vane aperture 136*c* located proximate first circumferential end 200, a vane aperture 136*d* located proximate second circumferential end 202, and a vane aperture 136*e* located between vane aperture 136*c* and vane aperture 136*d*. Vane apertures 136*c*, 136*d*, and 136*e* may each include a radially outward bore 220 and a radially inward bore 222. Radially outward bores 220 may be defined by radially outward 143*b* of second shroud segment 132*b*. Radially inward bores 222 may be defined by radially inward portion 141*b* of second shroud segment 132*b*.

Figure 8A:
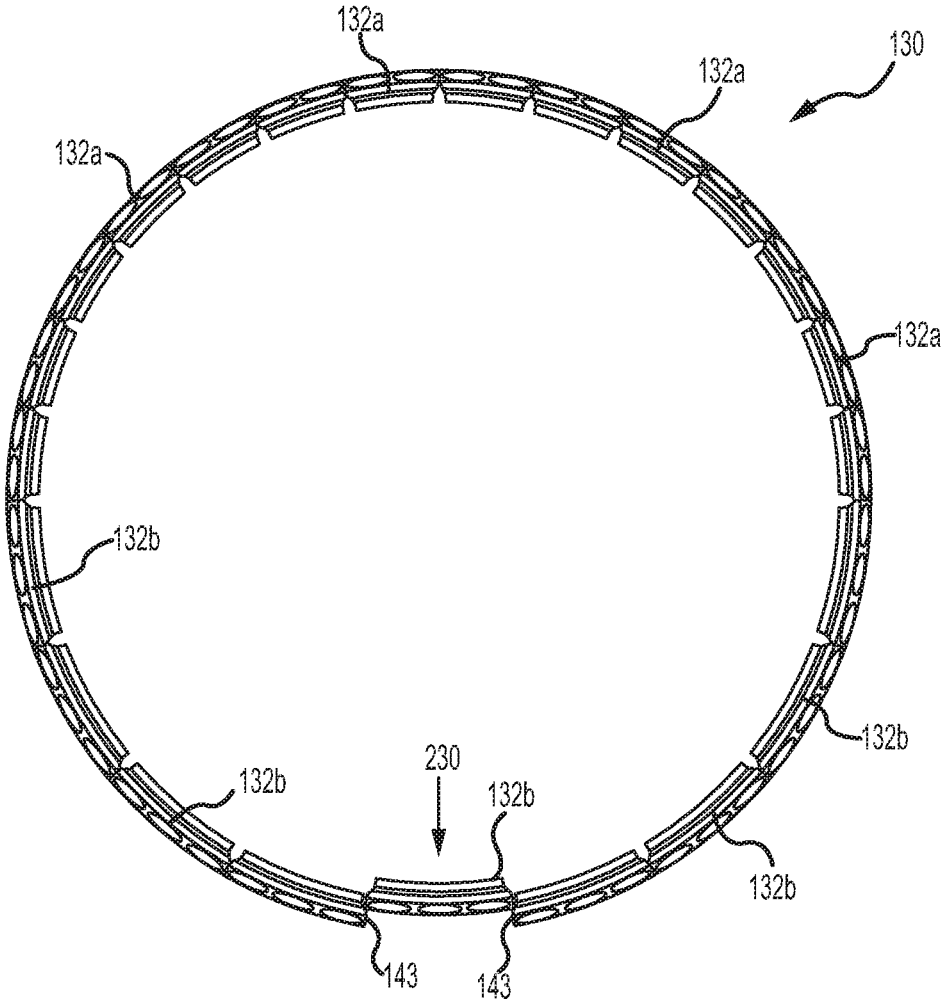
FIGS. 8A and 8B illustrate a shroud segment being inserted radially between circumferentially adjacent shroud segments, in accordance with various embodiments.

With reference to FIG. 8A, insertion of a final shroud segment 132 during assembly of shroud 130 is illustrated. Shroud 130 may be assembled by locating each first and second shroud segment 132*a*, 132*b* at an ID of shroud 130 and translating the shroud segment in the radially outward direction (i.e., in the direction of arrow 230). In various embodiments, translating the shroud segment in the radially outward direction may cause the translated shroud segment to contact the circumferentially adjacent shroud segment(s).

Figure 8B:
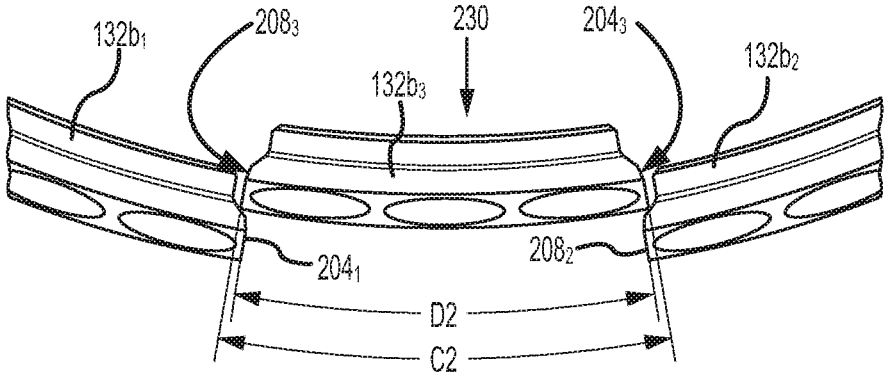

For example, and with reference to FIG. 8B, a circumferential distance D2 between previously inserted second shroud segments 132$b_1$ and 132$b_2$ may be less than circumferential length C2 of the second shroud segment 132$b$3 being inserted. Inserting second shroud segment 132$b_3$ between second shroud segments 132$b_1$ and 132$b_2$ may create an interference between radially outward circumferential surface 204$_1$ of second shroud segment 132$b_1$ and radially outward circumferential surface 208$_3$ of second shroud segment 132$b_3$, and between radially outward circumferential surface 208$_2$ of second shroud segment 132$b_2$ and radially outward circumferential surface 204$_3$ of second shroud segment 132$b_3$. As second shroud segment 132$b_3$ is inserted between second shroud segments 132$b_1$ and 132$b_2$ (i.e., translated in the direction of arrow 230), the interference may force second shroud segments 132$b_1$ and 132$b_2$ to translate circumferentially away from second shroud segment 132$b_3$, thereby reducing or eliminating any space between radially outward portions 143 of first and second shroud segments 132$a$, 132$b$ in FIG. 8A. In various embodiments, the interference may force the radially outward portions 143 of first and second shroud segments 132$a$, 132$b$ into compression. While FIGS. 8A and 8B illustrate inserting a second shroud segment 132$b$ to complete shroud 130, it is further contemplated and understood that a first shroud segment 132$a$ may be the final shroud segment inserted.

With momentary combined reference to FIGS. 6A, 7A, and 8B, grooves 175 in first shroud segments 132$a$ and grooves 205 in second shroud segments 132$b$ may be configured such that the interference during insertion of first and second shroud segments 132$a$, 132$b$ occurs gradually, thereby allowing first and second shroud segments 132$a$, 132$b$ to be more easily inserted.

FIG. 9A illustrates a first shroud segment 132$a_1$ being coupled to ID vane ends 103. First shroud segment 132$a_1$ is located radially inward of ID vane ends 103 and then translated in the radially outward direction (i.e., in the direction of arrow 230) to locate ID vane ends 103 within vane apertures 136. In various embodiments, translating the first shroud segment 132$a_1$ in the radially outward direction may cause first shroud segment 132$a_1$ to contact (i.e., generate an interference with) a circumferentially adjacent first shroud segment 132$a_2$. Insertion of first shroud segment 132$a_1$ onto vanes 100 may force first shroud segment 132$a_2$ and the ID vane ends 103 located in first shroud segment 132$a_2$ to translate circumferentially in the direction of arrow 232. In various embodiments, low pressure compressor case 90 and OD vane ends 102 are configured to tolerate circumferential translation of ID vane ends 103. Stated differently, the distance D1, with momentary reference to FIG. 2B, between outer circumferential surface 107 of OD trunnion 106 and inner circumferential surface 109 of bushing 108 may be configured to allow OD trunnion 106 to translate or "tilt" within bushing 108.

FIG. 9B illustrates an OD vane end 102 in a "tilted" position. Busing 108 and OD trunnion 106 may be configured to include a tolerance with allows for circumferential translation of OD trunnion 106 within busing 108. With combined reference to FIGS. 9A and 9B, translation of ID vane end 103 may cause a first radially outward portion 240 of OD trunnion 106 to contact inner circumferential surface 109 of bushing 108, while a second radially outward portion 242 of OD trunnion 106 is spaced apart from inner circumferential surface 109 of busing 108, thereby forming a first gap G1 between second radially outward portion 242 of OD trunnion 106 and inner circumferential surface 109 of busing 108. A first radially inward portion 244 of OD trunnion 106 may contact inner circumferential surface 109 of busing 108, while a second radially inward portion 246 of OD trunnion 106 is spaced apart from inner circumferential surface 109 of busing 108, thereby forming a second gap G2 between second radially inward portion 246 of OD trunnion 106 and inner circumferential surface 109 of busing 108. Second radially outward portion 242 and first radially inward portion 244 of OD trunnion 106 are oriented away from first radially outward portion 240 and second radially inward portion 246, respectively. Second radially outward portion 242 and first radially inward portion 244 of OD trunnion 106 are oriented generally away from the shroud segment being inserted (e.g., away from first shroud segment 132$a_1$ in FIG. 9A).

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosures is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods, and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A shroud assembly, comprising:

a first ring;

a second ring aft of the first ring; and a shroud disposed between the first ring and the second ring, the shroud comprising a plurality of circumferentially adjacent shroud segments, wherein each shroud segment of the plurality of circumferentially adjacent shroud segments extends axially from the first ring to the second ring, and wherein a first shroud segment of the plurality of circumferentially adjacent shroud segments defines a first number of vane apertures, and wherein a second shroud segment of the plurality of circumferentially adjacent shroud segments defines a second number of vane apertures different from the first number of vane apertures.

2. The shroud assembly of claim 1, wherein at least one of the first ring or the second ring includes an anti-rotation protrusion located between the first shroud segment and the second shroud segment of the plurality of circumferentially adjacent shroud segments, and wherein the first shroud segment is circumferentially adjacent to the second shroud segment.

3. The shroud assembly of claim 1, wherein each vane aperture of the first number of vane apertures comprises:

a first bore including a first diameter; and a second bore including a second diameter less than the first diameter.

4. The shroud assembly of claim 1, wherein the plurality of circumferentially adjacent shroud segments comprises a plurality of first shroud segments and a plurality of second shroud segments, the plurality of first shroud segments including the first shroud segment, the plurality of second shroud segments including the second shroud segment, and wherein each first shroud segment of the plurality of first shroud segments defines two vane apertures, and wherein each second shroud segment of the plurality of second shroud segments defines three vane apertures.

5. The shroud assembly of claim 4, wherein the first shroud segment forms a first percentage of an outer circumference of the shroud, and wherein the second shroud segment forms a second percentage of the outer circumference of the shroud different from the first percentage.

6. The shroud assembly of claim 5, wherein the plurality of first shroud segments forms approximately 180° of the shroud.

7. A vane assembly for a gas turbine engine, comprising:

an outer case;

a plurality of vanes radially inward of the outer case; and a shroud assembly located radially inward of the plurality of vanes, the shroud assembly comprising:

a first ring;

a second ring; and a shroud disposed between the first ring and the second ring, the shroud comprising a plurality of circumferentially adjacent shroud segments, wherein each shroud segment of the plurality of circumferentially adjacent shroud segments extends axially from the first ring to the second ring, and wherein a first shroud segment of the plurality of circumferentially adjacent shroud segments receives a first number of vanes of the plurality of vanes, and wherein a second shroud segment of the plurality of circumferentially adjacent shroud segments receives a second number of vanes of the plurality of vanes different from the first number of vanes.

8. The vane assembly of claim 7, wherein a first vane of the plurality of vanes comprises:

an inner diameter trunnion located within a vane aperture defined by the first shroud segment of the plurality of circumferentially adjacent shroud segments; and an outer diameter trunnion located within an outer vane aperture defined by the outer case.

9. The vane assembly of claim 8, further comprising a bushing located between the outer case and the outer diameter trunnion of the first vane, wherein a distance between an outer circumferential surface of the outer diameter trunnion and an inner circumferential surface of the bushing is configured to allow the outer diameter trunnion to tilt circumferentially within the bushing.

10. The vane assembly of claim 7, wherein at least one of the first ring or the second ring includes an anti-rotation protrusion.

11. The vane assembly of claim 10, wherein a first circumferential end of the first shroud segment and a second circumferential end of the second shroud segment define a gap configured to receive the anti-rotation protrusion.

12. The vane assembly of claim 7, wherein a circumferential surface of each shroud segment of the plurality of circumferentially adjacent shroud segments defines a groove.

13. A shroud for a vane assembly, comprising:

a first shroud segment defining a first number of vane apertures; and a second shroud segment circumferentially adjacent to the first shroud segment, wherein the second shroud segment defines a second number of vane apertures different from the first number of vane apertures.

14. The shroud of claim 13, wherein a radially outward portion of the first shroud segment contacts a radially outward portion of the second shroud segment, and wherein a radially inward portion of the first shroud segment is spaced apart circumferentially from a radially inward portion of the second shroud segment.

15. The shroud of claim 13, wherein the first shroud segment defines two vane apertures.

16. The shroud of claim 13, wherein the first shroud segment and the second shroud segment each comprises:

a first axial surface;

a second axial surface oriented away from the first axial surface;

a forward lip extending in a first direction from the first axial surface; and an aft lip extending in a second direction from the second axial surface, wherein the second direction is opposite the first direction.

17. The shroud of claim 13, wherein a circumferential surface of at least one of the first shroud segment or the second shroud segment defines a groove.

18. The shroud of claim 13, further comprising a third shroud segment circumferentially adjacent to the second shroud segment, wherein a radially outward portion of the second shroud segment contacts a radially outward portion of the third shroud segment, and wherein a radially inward portion of the second shroud segment is spaced apart circumferentially from a radially inward portion of the third shroud segment.

* * * * *